US010662724B2

(12) United States Patent
Slack

(10) Patent No.: US 10,662,724 B2
(45) Date of Patent: May 26, 2020

(54) GRIP ELEMENTS FOR GRIPPING CORROSION-RESISTANT TUBULARS

(71) Applicant: NOETIC TECHNOLOGIES INC., Edmonton (CA)

(72) Inventor: Maurice William Slack, Edmonton (CA)

(73) Assignee: NOETIC TECHNOLOGIES INC, Edmondton (CA)

( * ) Notice: Subject to any disclaimer, the term of this patent is extended or adjusted under 35 U.S.C. 154(b) by 0 days.

(21) Appl. No.: 16/345,802

(22) PCT Filed: Nov. 1, 2017

(86) PCT No.: PCT/CA2017/000238
§ 371 (c)(1),
(2) Date: Apr. 29, 2019

(87) PCT Pub. No.: WO2018/081889
PCT Pub. Date: May 11, 2018

(65) Prior Publication Data

US 2019/0249501 A1 Aug. 15, 2019

Related U.S. Application Data

(60) Provisional application No. 62/416,226, filed on Nov. 2, 2016.

(51) Int. Cl.
*E21B 19/10* (2006.01)
*E21B 19/06* (2006.01)

(52) U.S. Cl.
CPC ..... *E21B 19/10* (2013.01); *E21B 19/06* (2013.01)

(58) Field of Classification Search
CPC ..... E21B 19/06; E21B 19/07; E21B 19/20; E21B 19/10; Y10S 294/902
(Continued)

(56) References Cited

U.S. PATENT DOCUMENTS 5,451,084 A * 9/1995 Jansch ..... B25B 1/241 166/77.53
5,971,086 A 10/1999 Bee et al.
(Continued)

OTHER PUBLICATIONS

International Search Report re PCT/CA2017/000238, issued by the ISA/CA dated Jan. 31, 2018.
(Continued)

*Primary Examiner* — Dean J Kramer
(74) *Attorney, Agent, or Firm* — Donald V. Tomkins

(57) ABSTRACT

A grip element for gripping a tubular CRA workpiece has a hardened grip surface carrying an array of generally pyramidic die teeth, which may have either pointed or rounded tips, with the configuration of the tooth tips being selected for effective gripping of the CRA workpiece by way of an interference grip, and without unacceptably marking the CRA workpiece. The die tooth density over the grip surface may be selected to minimize accumulation of contaminants between teeth and/or to facilitate removal of accumulated contaminants. The substrate of the grip element may comprise a stainless steel having no free iron, with the grip surface being hardened by nitriding. Optionally, the tips of the grip element may truncated after nitriding to partially expose the stainless steel substrate. In alternative embodiments, the grip element may have a carbon steel substrate with a nitrided grip surface.

5 Claims, 3 Drawing Sheets

(58) Field of Classification Search
USPC ..... 294/102.2
See application file for complete search history.

(56) References Cited

U.S. PATENT DOCUMENTS

| | | | | |
|---|---|---|---|---|
| 6,079,509 | A | 6/2000 | Bee et al. | |
| 6,378,399 | B1 | 4/2002 | Bangert | |
| 7,036,397 | B2 * | 5/2006 | Bangert | E21B 19/07 81/57.15 |
| 2004/0194967 | A1 * | 10/2004 | Jaensch | B25B 13/5016 166/380 |
| 2004/0207223 | A1 | 10/2004 | Bee et al. | |
| 2007/0272417 | A1 * | 11/2007 | Benson | E21B 19/10 166/379 |
| 2014/0352943 | A1 | 12/2014 | Domec et al. | |

OTHER PUBLICATIONS

Written Opinion of the International Searching Authority re PCT/CA2017/000238, issued by the ISA/CA dated Jan. 31, 2018.
Tech Update: A brief explanation of oil field dies, the evolution of the Clincher™ Tong Die, and advances in hydraulic power tong technology—Superior Manufacturing & Hydraulics, Jan. 11, 2005.
Dies and Inserts Catalogue—McCoy Global, 2009.

* cited by examiner

GRIP ELEMENTS FOR GRIPPING CORROSION-RESISTANT TUBULARS

FIELD

The present disclosure relates in general to grip surfaces of grip elements used in equipment for applying axial and torsional loads to tubular workpieces, including but not limited to tubular workpieces made from corrosion-resistant alloys (CRAs), such as CRA tubulars used for drill pipe and casing in wellbore construction and completion operations in the oil and gas industry, as well as well drilling operations for geothermal applications.

BACKGROUND

Tubular strings used to construct and complete wellbores typically comprise tubular segments joined by threaded connections. The operations of assembling such tubular strings and installing them into a wellbore, and disassembling such strings and removing them from a wellbore, are commonly referred to as "tubular running" (i.e., running the tubular string either into or out of the wellbore). Where the tubular string involved is a string of casing (as opposed to, for example, a string of drill pipe or a string of production tubing), these operations may alternatively be referred to as "casing running". The process of making a threaded connection between two segments of a tubular string is commonly referred to as "making up" the connection, and the process of disconnecting two segments is called "breaking out" the connection.

For conventional drilling rigs that use a rotary table to rotate the drill string, tubular-running operations typically require the use of apparatus such as slips, elevators, and spiders to carry the weight of the tubular string while a tubular segment is being either added to or removed from the string, as well as power tongs to apply torque for make-up and break-out of threaded connections. For drilling rigs that use a "top drive" to rotate the drill string instead of a rotary table, it is increasingly common to use tubular-running tools attached to the top drive quill to structurally and sealingly connect to the upper end of a tubular segment, enabling the top drive to be used for make-up and break-out operations, and to react vertical hoisting loads (from the weight of the string) and torsional loads induced during connection make-up and break-out, while also enabling continuity of drilling fluid circulation through the top drive and the tubular string. Top-drive-equipped drilling rigs can also be used for "casing drilling" (or "drilling with casing"), which are terms used to describe the increasingly common practice of drilling a wellbore with a drill bit connected to the lower end of a casing string, such that the wellbore will already be cased once it has been drilled to the desired depth. This method replaces the separate sequential operations of drilling the wellbore, extracting the drill string, and inserting a casing string, as in traditional wellbore construction methods, with the single operation of drilling the wellbore with a permanent casing string.

Regardless of the type of drilling rig being used, most tubular-running operations (including casing drilling operations) require some type of tubular-handling equipment carrying grip elements having grip surfaces for engaging and gripping either the outer or inner surface of a tubular workpiece, in conjunction with the application of a radially-oriented normal force, to develop sufficient traction to prevent both axial and circumferential sliding of the grip surface relative to the tubular surface under application of applied axial and torsional loads during hoisting and during connection make-up and break-out.

The resultant of these applied loads is thus carried as a tangential shear load across an interfacial engagement region between the grip surface and the surface of the tubular. To prevent sliding, the product of the normal force multiplied by the effective friction coefficient of the interfacial region (i.e., the traction limit) must always be greater than the combined applied loads acting as a shear force transmitted across the interfacial engagement region to the tubular surface in the region of contact. In the majority of industry wellbore construction and completion applications, the grip mechanisms rely on some form of mechanical feedback—so-called "self-activating" grips—where increased applied load correlatively increases the normal force acting across the interfacial region, in the manner of a mechanical advantage.

The self-activating grip mechanisms of such tubular-handling apparatus are typically configured to include the familiar wedge grip configuration—directly in the case of hoisting equipment such as slips, and in a radially-adapted form in the case of power tong grips. For tubular-handling applications, this wedge grip configuration is generally characterized by two or more opposing, movable grip elements or "wedges" acting together in a generally annular space between the handling equipment body on one side (i.e., the sliding surface) and the surface of a tubular workpiece on the other (i.e., the grip surface), and arranged so that activation force applied to the grip element tends to cause sliding of the wedges against the handling equipment on a selected cam, ramp, or wedge angle so as to move the grip elements radially toward the workpiece, and thus urge the grip surfaces of the grip elements into contact with the workpiece. The activation force, in the foregoing context, is to be understood as the vector sum of the tangential load carried by the grip surface and any additional force otherwise applied to the grip element and also acting in a tangential direction such as implemented in hydraulic or pneumatic "powered" slips.

The ratio of grip element movement in the direction of loading to radial movement (relative to the hoisting equipment body) is controlled by the selected wedge angle, and together with friction forces arising on the sliding surface defines the mechanical force advantage of the system—i.e., the radial force acting normal to the workpiece surface, divided by the net activation force. Self-activation occurs when at least a portion of the activation force is provided by applied load acting tangentially on the grip surface. In typical manual slips, the activation force is provided almost entirely by the applied axial load, where only the gravity load of the slip assembly adds to the axial hoisting load. As an additional constraint on such equipment relying on largely self-activating wedge-grip-type mechanisms, it is also often necessary for the system to be self-releasing upon unloading—meaning that the wedge angle slope cannot be less than the static friction coefficient acting upon unloading.

Accordingly, and as is well known in the art (within practical limits allowing for lubrication on typical sliding surfaces such as slips in a slip bowl), a wedge angle of approximately 9 degrees is commonly considered to be a minimum (for example, a diameter taper of 4 inches per foot, or a 9.46-degree wedge angle, is an API industry standard for slip bowls). Relating this to the mechanical advantage of wedge grip mechanisms for common ranges of lubrication means that the mechanical advantage of these systems is in the order of 3:1 (near sticking to unload) and more typically 4:1 when normally lubricated. The inverse of this mechanical advantage translates to effective friction coefficients in the order of 0.25 to 0.33 for the traction limit of a grip interface as described above. Therefore, the traction limit actually present must exceed this for all levels of applied load to avoid slippage, and thus to avoid the risk of damage to the tubular workpiece or a dropped string.

For common wellbore operations using carbon steel tubulars, and particularly in environments where there is a risk of contamination of tubular surfaces by contaminants such as mill varnish, paint, mill scale, granular debris (e.g., sand and dirt), drilling fluids, corrosion inhibitors, etc., sufficiently high traction limits typically are not reliably achievable from pure friction between available grip surface materials in normal contact with carbon steel tubular surfaces. To overcome this challenge, grip surfaces are commonly provided on elements known as dies. Dies for gripping carbon steel tubulars are typically made from high-strength steel, with grip surfaces machined to carry what are variously described as teeth or wickers. The dies are adapted for rigid but removable structural mounting to movable grip elements, so that they can be replaced when the teeth or wickers become worn or damaged.

For reliable gripping effectiveness, it is typically necessary for the teeth or wickers on the dies to achieve some degree of physical penetration into the surface of the tubular workpiece, to induce a sufficient effective friction coefficient under load to provide a sliding resistance significantly greater than would be achievable from the more "pure" friction coefficient of the interfacial region. This particular type of gripping mechanism (i.e., combining friction resistance with mechanical interaction resulting from physical penetration into the workpiece) will be referred to herein as an "interference grip" mechanism.

To promote such penetration and minimize wear (and thus increase die service life), the teeth or wickers are usually surface hardened (such as by carburizing) to give them a hardness greater than that of the target workpiece. Consequently, the local friction coefficient achieved on the hard tooth surface against dry carbon steel tends to be low, and particularly so when acting through trapped debris or other contaminants that can have a lubricating (i.e., friction-reducing) effect. Therefore, the load flank angle of a die tooth penetrating the workpiece surface must be sufficiently steep to counter the tendency of the tooth to climb out of engagement under load.

Additionally, there are other known variables that can affect the traction of the interference grip mechanism, in the context of normal stress influencing the extent and effectiveness of initial tooth engagement with the workpiece (i.e., initial "bite") and final tooth penetration depth resulting from the maximum normal stress present when gripping. Included among these variables are tooth shape (e.g., wedge shape or pyramid shape) and tooth distribution (e.g., tooth distribution pattern and density). Furthermore, the tooth height relative to the "valleys" or void spaces between die teeth should be sufficient to penetrate any surface contaminant layer that might be present, and ideally should be arranged to accommodate the associated contaminant debris in a manner that will allow the contaminants to self-clean (i.e., to fall out of the intra-tooth valleys), or at least so as to enable periodic debris removal to avoid the loss of adequate penetration and consequent loss of effective tractive resistance.

In general, then, and as is well known for almost all such gripping applications, die teeth with a coarser-textured grip surface will have comparatively greater gripping effectiveness than die teeth with a finer-textured grip surface, but will typically cause deeper workpiece marking or surface damage. On the other hand, a finer-textured grip surface may be more susceptible to intra-tooth plugging and loss of penetration depth due to wear, and therefore may not be able to reliably and durably provide the necessary tractive resistance to prevent slippage across the interface between the dies and the tubular workpiece. Therefore, the design of a grip surface for a given application will typically involve a balancing of these practical considerations.

Where wellbore applications require the use of tubulars made from a corrosion-resistant alloy (CRA), such as but not limited to a stainless steel, more stringent constraints are usually placed on the handling equipment than for comparable carbon steel tubulars, in order to preserve the corrosion-resisting properties of the CRA tubulars. Tubular-running equipment is commonly required to use so-called "non-marking" dies.

Where the CRA tubular material is stainless steel, it is commonly a further requirement that the tubular-handling equipment must avoid contact with any material that might result in the transfer of "free iron" onto the surface of the stainless steel tubulars (such as would typically result from contact between stainless steel and conventional carbon steel). This is because iron transfer has a well-known deleterious effect on the ability of stainless steel to form and maintain an uninterrupted passivating oxide layer, which is essential to stainless steel's ability to resist corrosion. For these reasons, conventional grip elements using hardened carbon steel typically must be avoided when handling CRA tubulars—in this regard, see industry standards ISO 13680 ("Petroleum and natural gas industries—Corrosion-resistant alloy seamless tubes for use as casing, tubing and coupling stock—Technical delivery conditions") and API 5CRA ("Specification for Corrosion-resistant Alloy Seamless Tubes for Use as Casing, Tubing, and Coupling Stock").

For obvious reasons, it is highly advantageous to adapt the grip surfaces of existing handling equipment to handle and run CRA tubulars. Therefore, equipment suppliers have sought to do so generally within the constraints of the existing wedge grip mechanisms used to handle carbon steel as described above.

Among such known adaptations are so-called grit-faced dies, which are commonly referred to as non-marking dies. Grit-faced dies find use in many CRA tubular handling applications, particularly where some amount of surface contamination must be accommodated. The grip surface is provided by size-controlled tungsten carbide or similar hard grit particles brazed onto a substrate, with the grit particles being randomly distributed over the substrate surface and arranged to protrude from the bonding layer of brazed material in much the same manner as the teeth or wickers of conventional machined dies. Both the grit particles and brazing materials are selected to avoid iron contamination.

The protruding grit particles thus function in the same general fashion as penetrating teeth or wickers on conventional dies, and result in indentations in the gripped tubular workpiece. Accordingly, grit-faced dies rely on an interference grip mechanism. It will be apparent that the size and shape of protruding grit particles, the density and distribution of the particles, and the brazing layer thickness all affect the actual marking geometry of a grit-faced die in addition to the general characteristics and dimensions of a grip mechanism. By careful selection of these properties and attention to manufacturing processes, acceptably small amounts of marking can apparently be achieved for many CRA applications.

However, detailed measurements of marking geometry have shown that marking in excess of expected limits is not uncommon, particularly due to random variations in the grit particle height, shape, and distribution, and that the severity of resultant local plastic deformation affecting corrosion resistance can be highly variable and more severe than deformations caused by conventional machined wedge-tooth dies. Furthermore, in field environments it is difficult to prevent these dies from filling with debris and therefore losing their effectiveness to the extent that operational practice calls for either frequent cleaning or complete replacement.

In CRA tubular-handling applications where even the low level of marking provided by so-called non-marking grit-faced dies is deemed unacceptable, more purely friction-based non-penetrating dies may be used provided that care is taken to eliminate surface contaminants. For these applications, the grip surface may incorporate a smooth-faced elastomer, a semi-metallic material, or a soft non-ferrous metal material such as aluminum.

However, in addition to requiring the tubular surfaces to be clean and dry, these grip configurations frequently require specialized handling equipment capable of applying additional activation load to the grip elements and reacted by the handling equipment body (for example, powered slips in spiders), to supplement the self-activation provided by the directly-applied load. This takes away the ability to use standard equipment, and the higher resulting radial load may thus be further limited by tubular collapse resistance or elastomer extrusion resistance, thus necessitating the use of yet further specialized tongs, slips, or elevators.

FIG. 1 schematically depicts the mechanics involved in the interaction between the grip surface of a slip or wedge grip and a tubular workpiece. FIG. 1 is a free body diagram of a self-activated grip element (slip segment) 10 acting as a wedge between a workpiece (e.g., casing) and a tapered sliding surface (slip bowl). Although not shown in FIG. 1, the tapered sliding surface of the slip bowl would be slidingly engaged by the sloped surface 12 on the left side of the slip segment 10 in FIG. 1, and the outer surface of the workpiece would be engaged by the toothed face 14 on the right side of slip segment 10.

Accordingly, slip segment 10 is "pinched" between the casing and the sliding surface of the slip bowl during the application of increasing axial load. Normal force vector N acting on sloped surface 12 of slip segment 10 induces shear load vector μN acting along sloped surface 12. Radial force vector $F_r$, acting normal to toothed surface 14 in reaction to normal force vector N, urges toothed surface 14 of slip segment 10 into the workpiece, and must be high enough to induce a sliding resistance force across the interface between the workpiece surface and toothed surface 14 greater than the applied axial hoist load $F_a$ in order to prevent sliding of slip segment 10 relative to the casing, both axially and circumferentially.

This simple system is governed by the following relationship between axial and radial forces during loading:

$$\frac{F_r}{F_a} = \frac{1 - \mu \tan \alpha}{\tan \alpha + \mu} = G_{ra} \qquad \text{Eqn. 1}$$

wherein:

$F_a$=axial load $F_r$=radial load $G_{ra}$=Radial to axial force Gain (ratio) during load increase μ=friction coefficient on cones α=radial cone angle Solving this equation to show the radial force as a function of the applied axial or hoisting load yields:

$$F_r = G_{ra} F_a \qquad \text{Eqn. 2}$$

BRIEF SUMMARY

The present disclosure teaches improved die tooth configurations for grip surfaces of grip elements used in apparatus for handling tubular workpieces (and CRA tubulars in particular), such as but not limited to conventional tongs, slips, and elevators, as well as grip elements used in tubular running tools used with top-drive-equipped drilling rigs (such as, but not limited to casing running tools (CRTs) as described in U.S. Pat. No. 7,909,120).

More specifically, the present disclosure teaches embodiments of a grip element particularly adapted for use with handling equipment for tubular CRA workpieces and incorporating a grip surface in which:

- the substrate material of the grip element carrying the grip surface comprises a selected stainless steel that is substantially free of free iron and that preferably has a chromium content at least equal to that of the target workpiece;
- the grip surface is provided with a plurality of die tooth structures projecting from the grip surface, wherein the tooth structures preferably are generally pyramidic in shape and are distributed substantially uniformly over the grip surface; and
- the surfaces of the toothed structures (or at least portions thereof) are strengthened and hardened by nitriding (which for purposes of the present disclosure is to be understood as including ferritic nitrocarburizing).

Nitriding and ferritic nitro-carburizing form a non-etching white layer also called the compound layer which is generally less than 0.0005 inches thick. This compound layer generally comprises some kind of iron nitride and contains no free iron. The layer beneath this compound layer is called the diffusion layer, and comprises iron nitride particles in a ferrous matrix, meaning that it will contain some free iron.

The generally pyramidic shape of the teeth and the distribution of teeth over the grip surface are preferably selected and arranged to provide a minimum die tooth density (i.e., maximum grip surface coarseness) to ensure the development of sufficient resistance to slipping between the grip element and the workpiece when subject to a selected maximum normal force acting on the grip element, while at the same time preventing tooth penetration into the tubular workpiece from exceeding a selected non-marking limit.

Certain embodiments in accordance with the present disclosure teach the selection of a CRA material for the grip element substrate as a means to minimize or prevent iron contamination generally, and specifically in cases where a portion of the nitride layer is intentionally removed to form a flat-topped tooth profile or is worn away due to use. However, in alternative embodiments of pyramidally-configured (or generally diamond-shaped) tooth profiles, the substrate material may be a quenched and tempered carbon steel, but with an intact nitride layer being provided in areas where the tooth surface may be in contact with a CRA workpiece. In such alternative embodiments, the nitride layer will preferably be formed at temperatures lower than the tempering temperature, thus avoiding reduction of strength and distortion associated with heat treatment above the tempering temperature, and promoting the required hardness to induce penetration and cause the free iron to be bound by the nitride layer to prevent iron contamination.

It is also known to further enhance the hardness of the outer nitride layer of such nitrided steels using vapor-based technologies at temperatures below the tempering temperature of the steel substrate. Such vapor-based technologies, which include physical vapor deposition (PVD) and plasma-enhanced chemical vapor deposition (PECVD) and variations thereof, simultaneously increase the thickness of the layer having little or no free iron. In this case, free iron is bound in the nitride layer (and perhaps enhanced by the PVD- or PECVD-affected zone) at the surface in the nitrogen-saturated layer, and only gradually increases with depth through the nitride-affected hardened zone.

Therefore, provided that care is taken to manage the amount of wear allowed for a given die surface, sufficiently low levels of iron contamination can be achieved using a carbon steel substrate with fully-nitrided die teeth for a given application. Accordingly, in applications where the amount of allowable die wear can be restricted so as to expose the workpiece only to die material having little or no free iron, satisfactory restriction of iron contamination may be achieved with the selection of a carbon steel substrate for the die tooth structure.

This relationship is similarly supported by other surface-hardening treatments for carbon steels, such as boronizing and chromizing. In boronizing (or boriding, as it is also known), boron consumes iron at the surface to form iron borides, leaving no free iron at the surface. However, these alternative treatments require temperatures exceeding the lower critical temperature of carbon steel. Accordingly, for applications that do not require the carbon steel substrate material to have properties that can only be achieved through an initial quenching and tempering process, such processes may also be employed to achieve a die tooth surface that is sufficiently hard and devoid of free iron.

In general summary, the present disclosure teaches gripping of CRA workpieces using grip elements having a corresponding or compatible CRA substrate defining a tooth structure comprising an array of pyramidal or generally diamond-shaped die teeth, with the tooth structure having a nitrided surface to provide the necessary strength and hardness to enable the die teeth to grippingly but non-markingly indent the CRA workpiece while preventing iron contamination thereof, including grip element embodiments in which the nitride layer has been worn off or intentionally removed.

However, alternative embodiments of gripping elements in accordance with the present disclosure can be made with a carbon steel substrate that is surface-hardened by means of nitriding or other surface-hardening treatments that, like nitriding, chemically bind free iron near the carbon steel surface. Provided that this treated (e.g., nitrided) surface is not removed or worn away, such grip elements may be used with CRA workpieces with little or no iron contamination.

Although other surface-hardening treatments can be used for such grip elements having carbon-steel substrates, nitriding is a preferred hardening process because it can be carried out below the tempering temperature of heat-treated carbon steels. This makes it possible for grip elements in accordance with the present disclosure to use a substrate material having good mechanical properties and accurate finished geometry but that does not lose strength or get distorted as could happen using alternative surface-hardening processes requiring higher treatment temperatures.

As previously noted, boronizing must be carried out at temperatures above the maximum tempering temperature for carbon steels. However, in applications requiring a stronger grip element substrate than may be available with nitrided carbon steel, this can be achieved by use of boronizing carbon steel grip elements (to provide the required hardness) followed by heat treating (to provide the required strength), thus providing surface-hardened gripping teeth with no surficial free iron.

Accordingly, the present disclosure also teaches methods for gripping a tubular workpiece wherein the tubular workpiece is made from a material comprising a corrosion-resistant alloy (CRA) and wherein the method includes the step of gripping the CRA workpiece with one or more grip elements comprises grip surfaces formed on substrates comprising a quenched and tempered carbon steel, with a plurality of die teeth projecting from each grip surface, and wherein:

(a) the die teeth are of generally pyramidic configuration, with each die tooth having a die tooth tip; and (b) at least portions of the grip surface and the die teeth surfaces have been treated with a surface-hardening process.

The surface-hardening process may be nitriding, boronizing, or chromizing. In embodiments of method in which the surface-hardening process is nitriding, the nitride grip surfaces may be further hardened using a physical vapor deposition (PVD) process or a plasma-enhanced chemical vapor deposition process (PECVD).

BRIEF DESCRIPTION OF THE DRAWINGS

Embodiments will now be described with reference to the accompanying Figures, in which numerical references denote like parts, and in which.

DESCRIPTION

Figure 1:
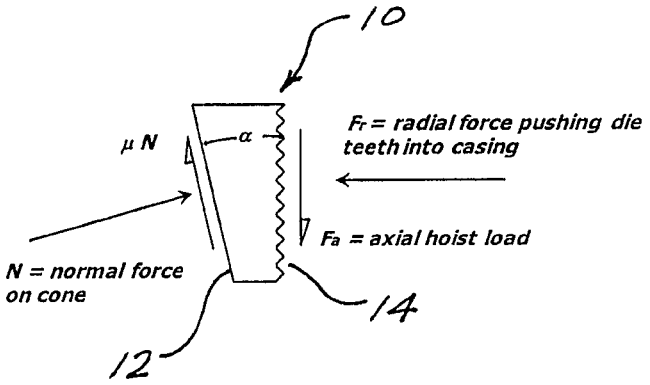
FIG. 1 is a free body diagram of a self-activated grip element acting as a wedge between a tubular workpiece and a tapered sliding surface of a hoisting apparatus.
Figure 2:
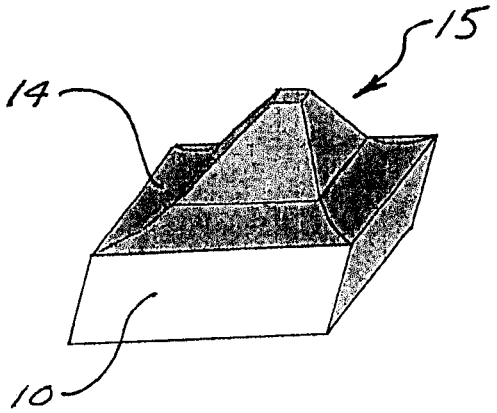
FIG. 2 is an oblique view of a generally representative example of a grip element tooth in accordance with the present disclosure.

FIG. 2 illustrates an isolated pyramidic die tooth 15 projecting from a grip surface 14 of a gripping element 10 in accordance with the present disclosure. FIGS. 3-6 are cross-sectional views of four alternative embodiments of grip elements 10 having a grip surface 14 characterized by a plurality of generally pyramidic die teeth, shown in gripping engagement with the outer wall surface 24 of a tubular workpiece 20 (with reference number 22 indicating the inner wall surface of tubular workpiece 20). The base material of the die teeth may be a corrosion-resistant alloy (CRA), such as but not limited to stainless steel. In FIGS. 3-6, reference number 30 denotes a nitrided surficial layer on the die teeth.

Figure 3:
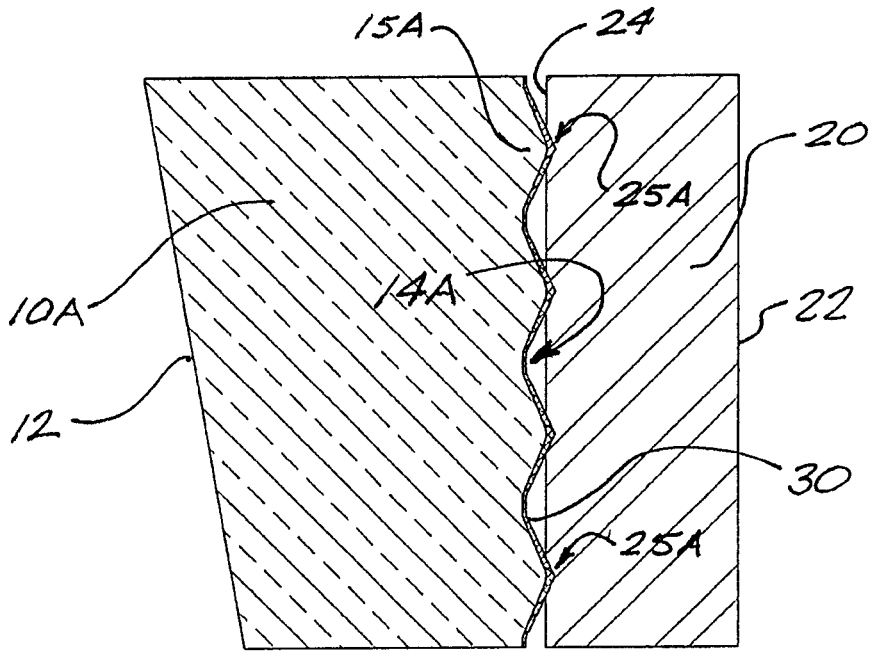
FIG. 3 is a cross-section through the interface between a tubular workpiece surface and the grip surface of a first embodiment of a grip element in accordance with the present disclosure, with the grip surface carrying die teeth having sharp tips.

FIG. 3 illustrates a grip element 10A having a grip surface 14A with generally pyramidic die teeth 15A in which the pyramidic form of the tooth has a comparatively sharp nitrided tip, to promote maximal penetration of a workpiece 20 for a given applied load (in FIG. 3, the indentations in workpiece 20 resulting from penetration by die teeth 15A are denoted by reference number 25A). Accordingly, die teeth in accordance with this embodiment will typically provide the most optimally effective interference grip (as compared with die teeth having other tip configurations), and therefore will typically provide the most effective slip resistance in the case of tubular workpieces having contaminated surfaces.

Figure 4:
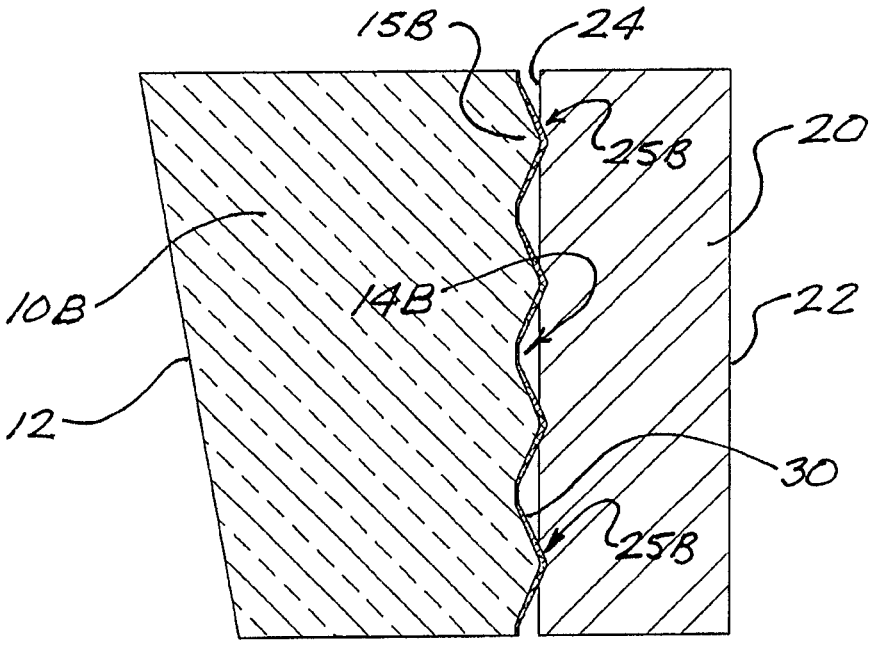
FIG. 4 is a cross-section through the interface between a tubular workpiece surface and the grip surface of a second embodiment of a grip element in accordance with the present disclosure, with the grip surface carrying die teeth having rounded tips.

FIG. 4 illustrates a grip element 10B having a grip surface 14B having die teeth 15B with rounded tips, so as to cause shallower indentations 25B in workpiece 20 than die teeth as in FIG. 3, for a given applied load. In this embodiment, the radius of curvature of the rounded tooth tip ideally will be the minimum radius required to prevent breakage of the otherwise sharp nitrided tip under in-service loadings.

Figure 5:
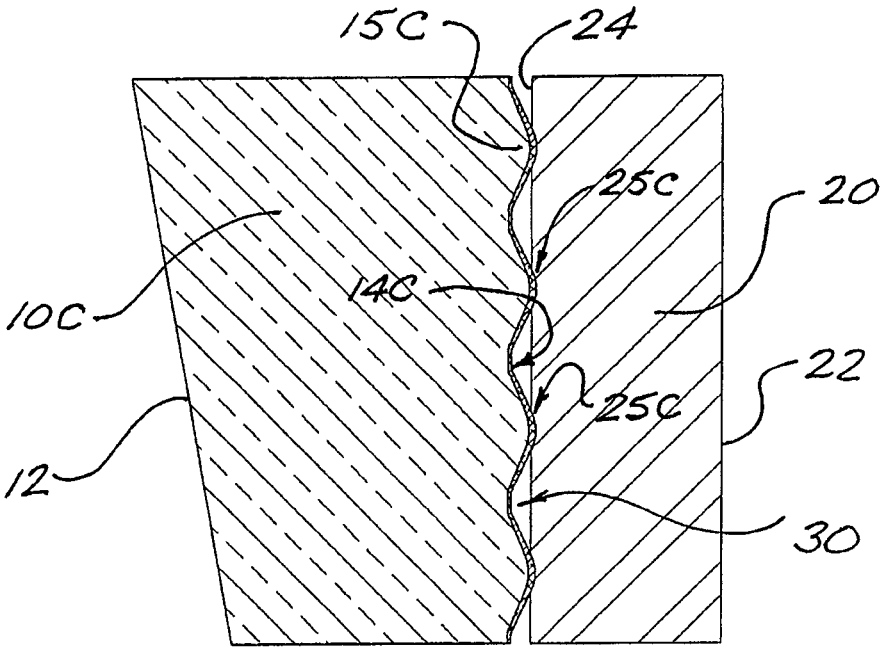
FIG. 5 is a cross-section through the interface between a tubular workpiece surface and the grip surface of a third embodiment of a grip element in accordance with the present disclosure, with the grip surface carrying die teeth having rounded tips with a larger rounding radius than in FIG. 4.

FIG. 5 illustrates a grip element 10C having a grip surface 14C having die teeth 15C with rounded tips similar to die teeth 15B in FIG. 4, but rounded at a larger rounding radius, such that the workpiece indentations 25C caused by die teeth 15C would be less than for die teeth 15B, for a given applied load, and therefore would cause less marking of the workpiece.

Figure 6:
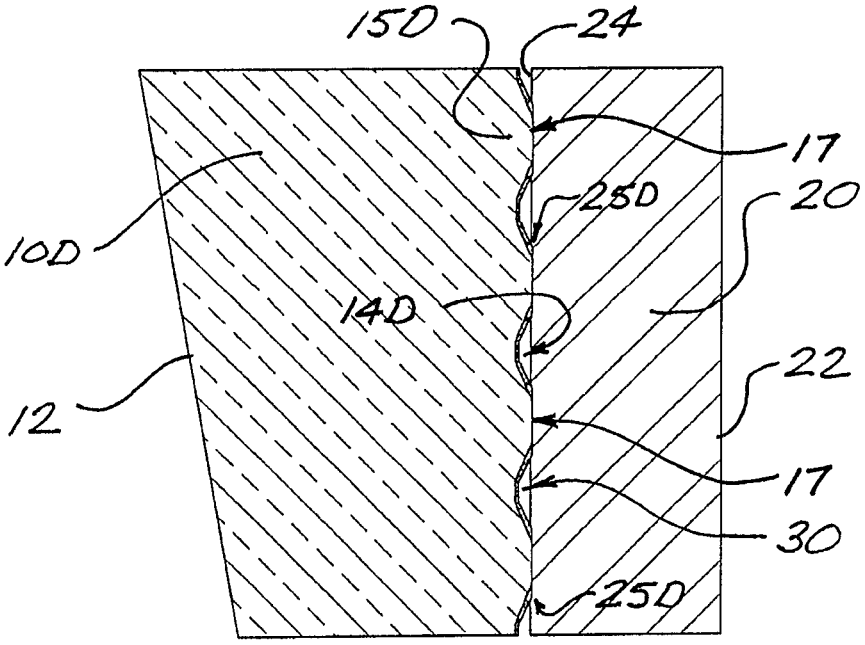
FIG. 6 is a cross-section through the interface between a tubular workpiece surface and the grip surface of a fourth embodiment of a grip element in accordance with the present disclosure, with the grip surface carrying die teeth having truncated tips, partially exposing the grip element substrate.

FIG. 6 illustrates a grip element 10D having a grip surface 14D having die teeth 15D with at least some of die teeth 15D having tips that have been truncated to form flattened surfaces 17. As graphically illustrated in FIG. 6, the workpiece indentations 25D caused by die teeth 15D would typically be less than for any of the die teeth shown in FIGS. 3-5 for a given applied load, because the provision of flattened surfaces 17 on teeth 15D increases the total tip contact surface area between grip surface 14D and workpiece surface 24 as compared to the total contact surface areas for the embodiments in FIGS. 3-5, thus resulting in a higher applied load being required to initiate effective gripping of workpiece 20 but with less penetration of workpiece 20 than would be caused by teeth having sharp or rounded tips.

Although reduced penetration in the workpiece may desirably reduce workpiece marking, it also results in a less effective interference grip, and thus tends to reduce sliding resistance across the grip interface. However, in the embodiment shown in FIG. 6, the tips of die teeth 15D have been truncated after nitriding, such that the exposed flattened surfaces 17 are stainless steel (or other selected CRA matching the tubular workpiece material), which is much softer than the nitrided surface. Accordingly, the sliding resistance developed in accordance with this embodiment will be supplemented by increased "pure" frictional resistance developed between the stainless steel flattened surfaces 17 and the stainless steel outer surface 24 of workpiece 20. This frictional resistance between flattened surfaces 17 and workpiece surface 24 will be greater than the frictional resistance that would develop if the tips of die teeth 15D were flattened before rather than after nitriding, because the coefficient of friction between two stainless steel surfaces is greater than the coefficient of friction between stainless steel and a nitrided surface (and the same would hold true for most CRAs).

Generally speaking, the rounding radius of rounded tooth tips (per FIG. 4 or 5) will be selected to provide maximum workpiece penetration at low applied loads while keeping the magnitude of stress risers caused by the geometry of the indentation root radius at manageable levels best supporting applications where an interference grip is required to accommodate surface contamination. The size of flattened tooth tips (per FIG. 6) will typically be selected to be no greater than required to just reach the threshold for penetration of the workpiece surface or yielding of the tooth structure at a selected maximum load, in order to maximize tooth tip contact stress, and to promote a correspondingly higher coefficient of friction for applications without significant surface contamination risk. The remaining nitride layer on the flanks of the flattened teeth will have the effect of supporting and strengthening the tooth structure to promote this goal of reduced tooth area, while exposing a softer, more frictional substrate that would otherwise yield, and tending to maintain sharper edges on the otherwise softer tooth, again promoting improved frictional interaction with the workpiece surface.

It will be readily appreciated by those skilled in the art that various modifications to embodiments in accordance with the present disclosure may be devised without departing from the present teachings, including modifications that use structures or materials later conceived or developed. It is to be especially understood that the scope of the claims appended hereto should not be limited by or to any particular embodiments described and illustrated herein, but should be given the broadest interpretation consistent with the disclosure as a whole. It is also to be understood that the substitution of a variant of a claimed element or feature, without any substantial resultant change in functionality, will not constitute a departure from the scope of the disclosure or claims.

In this patent document, any form of the word "comprise" is intended to be understood in a non-limiting sense, meaning that any item following such word is included, but items not specifically mentioned are not excluded. A reference to an element by the indefinite article "a" does not exclude the possibility that more than one such element is present, unless the context clearly requires that there be one and only one such element. Any use of any form of any term describing an interaction between elements is not meant to limit the interaction to direct interaction between the elements in question, but may also extend to indirect interaction between the elements such as through secondary or intermediary structure. Any use of any form of the word "typical" is to be interpreted in the sense of being representative of common usage or practice, and is not to be interpreted as implying essentiality or invariability.

As used in this patent specification, the term "carbon steel" is intended to be understood as including all carbon steels, including low alloy steels and all non-stainless steels.

The invention claimed is:

1. A method of manufacturing a grip element for gripping a tubular workpiece made from a corrosion-resistant alloy (CRA), wherein said method comprises the steps of:

(a) forming a grip element comprising a CRA substrate, wherein the grip element comprises a grip surface having a plurality of generally pyramidic die teeth projecting therefrom;

(b) treating at least portions of the grip surface and the die teeth surfaces with a surface-hardening process; and (c) subsequent to the surface-hardening step in clause (b), intentionally truncating at least some of the die teeth such that each truncated die tooth tip defines a flattened surface that includes an exposed surface of the CRA substrate.

2. A method as in claim 1 wherein the surface-hardening process comprises nitriding.

3. A method as claim 2, comprising the further step, performed prior to the step of intentionally truncating the die tooth tips, of further hardening the nitrided grip surface and the die teeth surfaces using a physical vapor deposition (PVD) process.

4. A method as in claim 2, comprising the further step, performed prior to the step of intentionally truncating the die tooth tips, of further hardening the nitrided grip surface and the die teeth surfaces using a plasma-enhanced chemical vapor deposition (PECVD) process, prior to truncation of the die tooth tips.

5. A method as in claim 1 wherein the surface-hardening process comprises boronizing.

* * * * *